United States Patent [19]

Gonzalez

[11] Patent Number: 4,676,309

[45] Date of Patent: Jun. 30, 1987

[54] LINEAR PLANE PERFORATOR

[75] Inventor: Manuel E. Gonzalez, Bishop, Tex.

[73] Assignee: Exxon Production Research Company, Houston, Tex.

[21] Appl. No.: 712,599

[22] Filed: Mar. 18, 1985

[51] Int. Cl.[4] ..... E21B 29/02

[52] U.S. Cl. ..... 166/55; 166/55.1; 175/4.6

[58] Field of Search ..... 175/2, 4.51, 4.6; 166/55.1, 55, 297, 299; 102/310, 306; 89/1.15

[56] References Cited

U.S. PATENT DOCUMENTS

| | | | |
|---|---|---|---|
| 4,134,453 | 1/1979 | Love et al. | 166/298 |
| 4,160,412 | 7/1979 | Snyer et al. | 166/299 X |
| 4,354,433 | 10/1982 | Owen | 102/310 X |

*Primary Examiner*—Stephen J. Novosad
*Assistant Examiner*—Matthew Smith
*Attorney, Agent, or Firm*—John S. Schneider

[57] ABSTRACT

A perforator for perforating a subsurface formation surrounding a well bore to ensure perforation of channels in a cement sheath surrounding a casing pipe cemented in said well bore comprising a series of stacked plates, each plate containing spaced apart co-planar, pie-shaped linear charges and a co-planar, pie-shaped non-charged spacer arranged between each of said linear charges. There are preferably four linear charges and four non-charged spacers forming each plate. The linear charges on each plate are spaced angularly from the linear charges on each other plate so that the linear charges are aimed at different angular portions of the bore hole.

5 Claims, 6 Drawing Figures

LINEAR PLANE PERFORATOR

BACKGROUND OF THE INVENTION

1. Field of the Invention

This invention concerns perforating guns and, more particularly, linear charge perforators used to perforate subsurface formations penetrated by oil and gas wells and the like.

2. Discussion of Prior Art

Generally, in completing oil and gas wells, a metal casing is positioned in a well bore. A cementitious material is then usually pumped into the annular space between the metal casing and the well bore. The cement permanently fixes the metal casing in the well bore and prevents migration of well fluids through the annular space. The casing, cement and formation are then perforated by either shaped charges or bullet perforators at the level of a producing formation.

However, channels often form in the cement behind the casing and it is desirable to close off those channels to prevent migration in the well of unwanted fluids through the cavities in the cement located space or annulus between the well bore and the casing.

The present system for perforating water channels and the cement behind the casing uses standard point charges at various angles of phasing to create a helix of shots in the casing wall. This system has used as low as 15° phasing which, when using four jet shots per foot, provides a 360° turn every six feet for a total of twenty-four shots. An example of such perforating apparatus is seen in U.S. Pat. No. 3,415,321, entitled "Shaped Charge Perforating Apparatus and Method," issued to A. A. Venghiattis Dec. 10, 1968.

As can be recognized in illustrations FIGS. 6 and 7 of that patent, a water channel in the cement behind casing might be missed using such perforating apparatus. Consequently, it is advantageous to provide a device which will insure close to 100% reliability of actually perforating a water channel in the cement behind the casing.

SUMMARY OF THE INVENTION

The present invention provides a simple device for insuring perforation of a water channel in the cement behind a casing. Linear charges are employed as opposed to point charges. A 360° circular plate contains a plurality of co-planar, pie-shaped (triangularly-shaped) linear charges spaced from each other by a series of co-planar, pie-shaped non-charged spacers with each linear charge and each spacer being about the same size. Preferably, there are four linear charges and four non-charged spacers in a plate. Any number of such plates may be stacked one on top of the other with each phased at a different angle to increase the likelihood of perforating into the water channel(s). There is only a small possiblity that a water channel in the cement behind the casing can escape being perforated in this manner.

DESCRIPTION OF THE PREFERRED EMBODIMENTS

Figure 1:
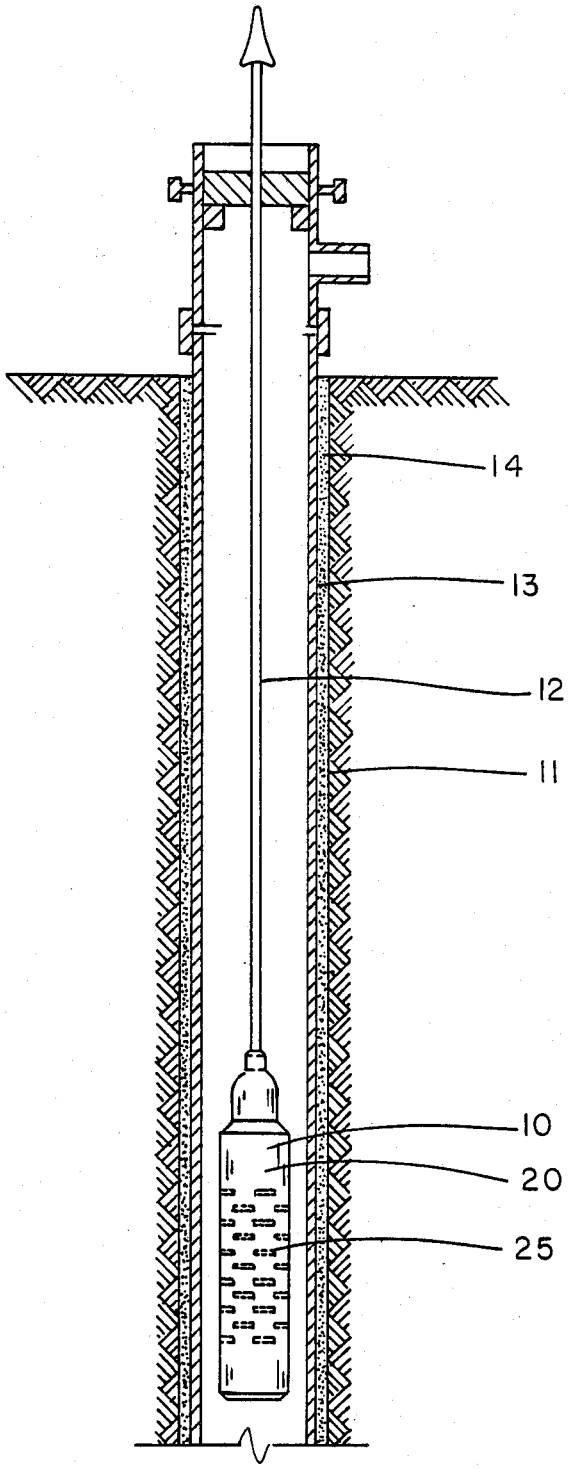
FIG. 1 is a schematic, side elevation showing a cross section through a well in which the plate type perforator unit of the invention is suspended on an electrically conductive cable.

Referring now to FIG. 1, there is illustrated a perforator unit 10 suspended in a well bore 11 on an electrical conductor cable or wire line 12. A casing or well pipe 13 is suspended in well bore 11 and a cement sheath 14 has been pumped into the annulus between well bore 11 and casing 13, as indicated. At the earth's surface wire line 12 is connected to standard equipment, not shown, used to detonate or fire linear charge perforators.

Perforator unit 10 includes a housing 20 which contains several vertically spaced-apart, stacked 360° circular perforator plates 25.

Figure 3:
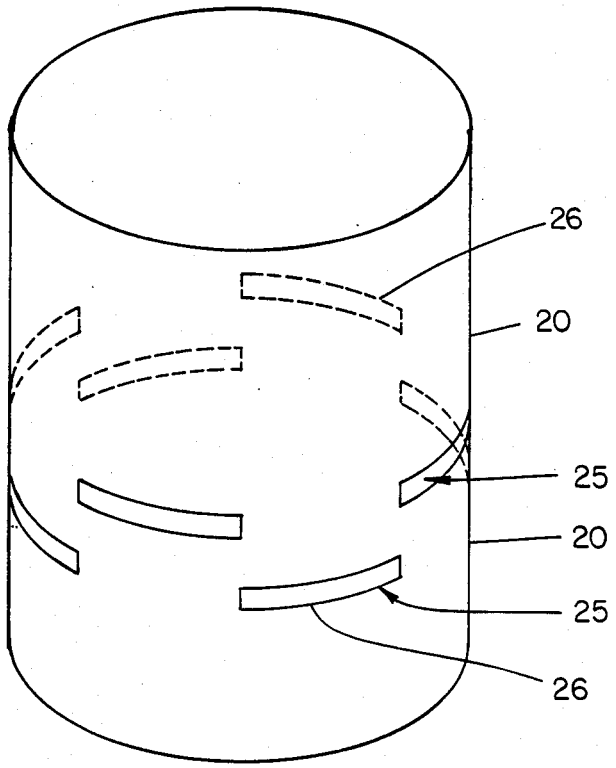
FIG. 3 shows casing perforating geometry when another 360° plate, identical to the plate shown in FIG. 2 but 45° out of phase, is positioned above that plate.
Figure 2:
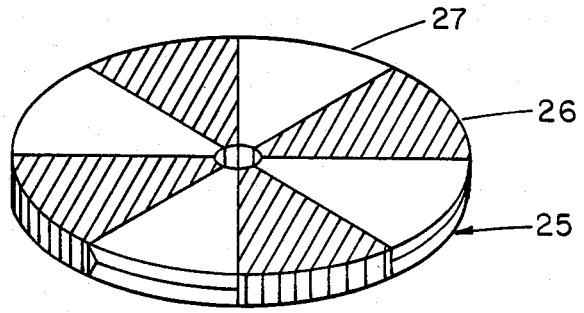
FIG. 2 is an enlarged view of one of the perforator plates shown in FIG. 1 and having four pie-shaped linear charges on the same plane, each separated from another by a non-charged spacer.

Referring to FIG. 2, each perforator plate 25 contains four pie-shaped linear charges 26 separated by four non-charged spacers 27. By placing another plate 25, identical to the plate of FIG. 2 but spaced vertically from and 45° out of phase therewith, the pattern shown in FIG. 3 is obtained.

Figure 4:
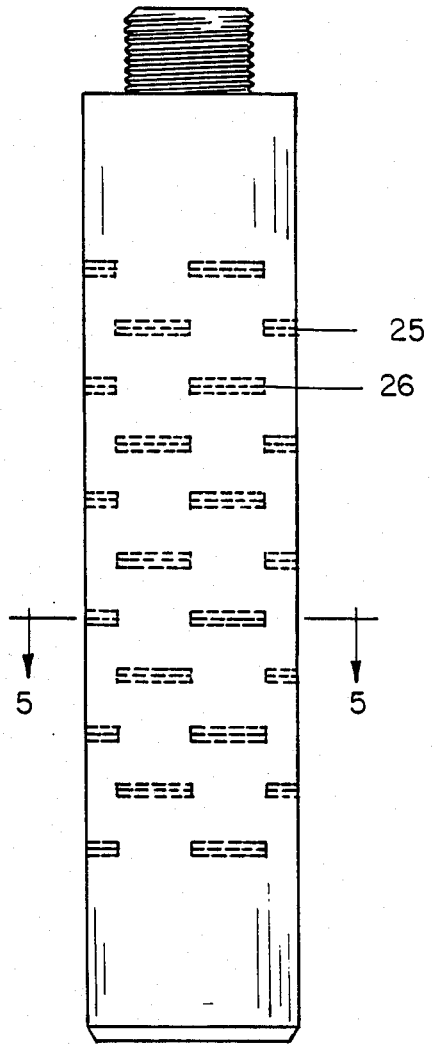
FIG. 4 is an enlarged view of the perforator unit shown in FIG. 1.
Figure 5:
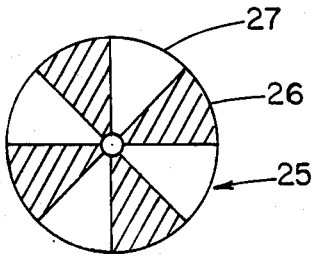
FIG. 5 is a view taken on lines 5—5 of FIG. 4.

In FIGS. 4 and 5, and in FIG. 4 particularly, each alternate plate 25 is shown arranged 45° out of phase from the adjacent plate(s) 25.

Figure 6:
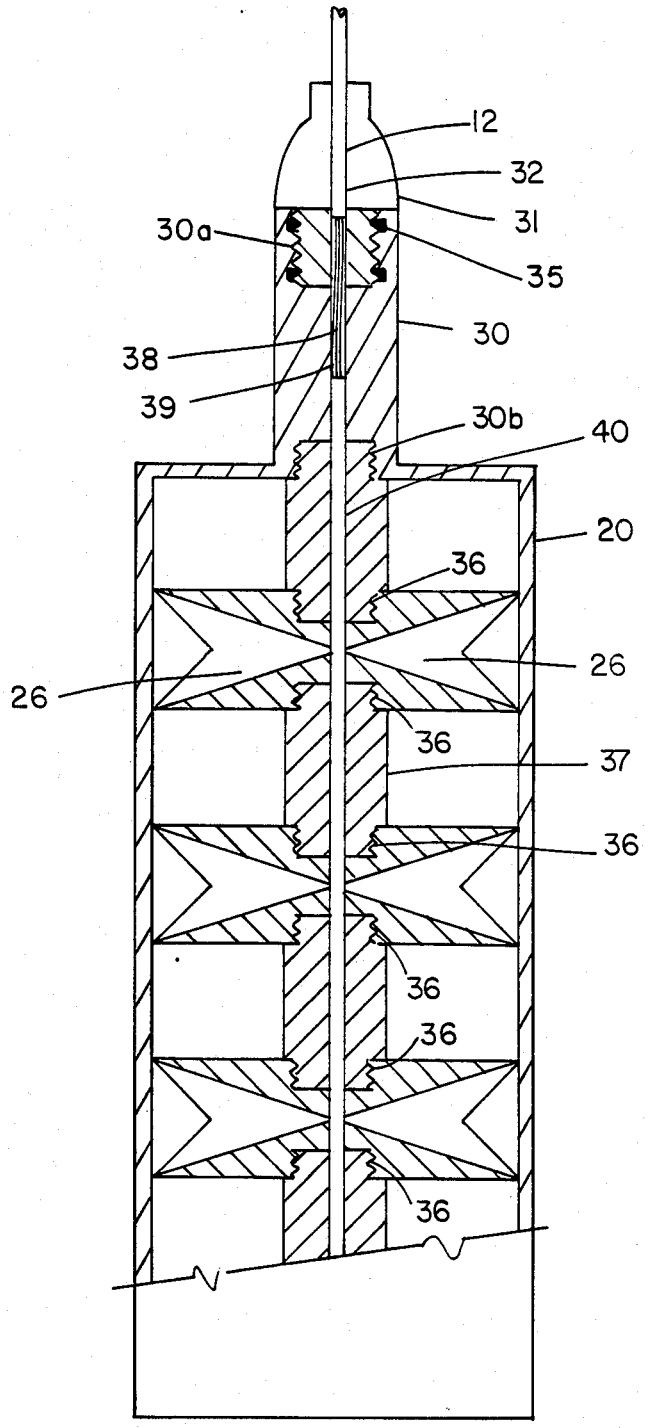
FIG. 6 is a cross-sectional view of the perforator unit.

Details of a suitable perforator unit 10 in accordance with the invention are shown in FIG. 6. As shown in that figure, perforator housing 20 includes an upper extended portion 30 having upper and lower threaded recesses 30*a* and 30*b*, respectively. A threaded cable or wire line head 31 has an opening 32 through which cable 12 extends, and is threaded into recess 30*a*. O-rings 35 are arranged on the mating threads to insure the connection is sealed off.

Housing 20 contains a series of vertically spaced-apart plates 25 each of which in turn contains an alternating series of shaped charges 26 and spacers (not shown). Each plate 25 contains upper and lower threaded recesses 36 for connecting the plates to spacers 37. The uppermost and lowermost spacers are threaded to housing 20 (only the upper such connection is shown threaded into recess 30*b* in housing 20). A detonator cord 40 extends through each spacer 37 and plate 25, and connects to a blasting cap 41 at its upper end.

The spacers and primer cord may be omitted, if desired, and all of the spacer plates may be made together in one piece with the primer running through the center of the piece. In operating the perforator, perforator unit 10 is lowered on electrically-conductive cable 12 from the earth's surface to a level at which it is desired to perforate a subsurface formation. Power to detonate the blasting cap and detonator cord is conveyed over cable 12 from an electrical power source at the surface in a manner known to those skilled in this art. Shaped charges 26 are then fired simultaneously and penetrate the subsurface formation at various levels and various angles in accordance with the number of plates and the arrangement of the shaped charges on such plates.

Plates 25 can be stacked one on top of the other in an unlimited number and phased at any angle deemed appropriate in order to increase the likelihood of perforating into a water channel. Each linear charge is aimed at a different portion of the borehole. After the water channel has been perforated, it may be squeezed with cement. Although preferred, it is not necessary that the charges and the non-charged spacers be the same sizes. Nor is it necessary that the plates be circular.

It is to be understood that the invention is not limited to the specific embodiment disclosed, but may embrace modifications as may fall within the scope of the appended claims.

What is claimed is:

1. Apparatus for perforating a metallic well casing and a cement sheath surrounding said well casing and a subsurface formation surrounding said well casing and cement sheath comprising:

a perforator unit suspendible in said well casing comprising at least two stacked plates, each plate having a plurality of co-planar linear charges spaced from each other and a co-planar non-charged spacer positioned between each of said linear charges;

said plates being phased angularly such that each of said linear charges is aimed at a different angular portion of said well casing.

2. Apparatus as recited in claim 1 in which each of said plates is circular.

3. Apparatus as recited in claim 2 in which the sizes of said linear charges and said non-charge spacers are substantially the same.

4. Apparatus as recited in claim 3 in which each plate comprises four linear charges and four non-charged spacers.

5. Apparatus as recited in claim 3 in which said linear charges and said non-charged spacers are pie-shaped.

* * * * *